US009912070B2

(12) United States Patent
Clayton et al.

(10) Patent No.: US 9,912,070 B2
(45) Date of Patent: Mar. 6, 2018

(54) GROUND-BASED SATELLITE COMMUNICATION SYSTEM FOR A FOLDABLE RADIO WAVE ANTENNA

(71) Applicant: Cubic Corporation, San Diego, CA (US)

(72) Inventors: William R. Clayton, Huntsville, AL (US); Charles Matthew Erwin, Madison, AL (US)

(73) Assignee: Cubic Corporation, San Diego, CA (US)

( * ) Notice: Subject to any disclaimer, the term of this patent is extended or adjusted under 35 U.S.C. 154(b) by 49 days.

(21) Appl. No.: 15/068,384

(22) Filed: Mar. 11, 2016

(65) Prior Publication Data

US 2017/0025745 A1 Jan. 26, 2017

Related U.S. Application Data

(60) Provisional application No. 62/131,295, filed on Mar. 11, 2015.

(51) Int. Cl.

| | |
|---|---|
| ***H01Q 15/16*** | (2006.01) |
| ***H01Q 19/13*** | (2006.01) |
| ***H01Q 1/12*** | (2006.01) |

(52) U.S. Cl.
CPC ..... *H01Q 15/161* (2013.01); *H01Q 1/12* (2013.01); *H01Q 1/1228* (2013.01); *H01Q 1/1235* (2013.01); *H01Q 19/13* (2013.01)

(58) Field of Classification Search
CPC ..... H01Q 15/161
See application file for complete search history.

(56) References Cited

U.S. PATENT DOCUMENTS

| | | | | |
|---|---|---|---|---|
| 4,608,571 A * | 8/1986 | Luly | F24J 2/125 | 343/781 P |
| 2007/0052612 A1* | 3/2007 | Trajkovic | H01Q 3/08 | 343/840 |

* cited by examiner

*Primary Examiner* — Robert Karacsony
(74) *Attorney, Agent, or Firm* — Kilpatrick Townsend and Stockton, LLP

(57) ABSTRACT

A satellite communications assembly has a foldable antenna that has a flexible reflector member and a flexible tension member. The assembly further has a feed assembly centrally disposed with respect to the foldable antenna and a plurality of reflector supports that extend radially from the feed assembly and coupled to the reflector member. Additionally, the assembly has a hub coupled to the feed assembly, the hub coupled to ends of a plurality of ground support legs.

14 Claims, 9 Drawing Sheets

GROUND-BASED SATELLITE COMMUNICATION SYSTEM FOR A FOLDABLE RADIO WAVE ANTENNA

CROSS-REFERENCE TO RELATED APPLICATIONS

This application claims priority to U.S. Provisional Patent Application Ser. No. 62/131,295 entitled Ground-Based Satellite Communication System for a Foldable Radio Wave Antenna and filed on Mar. 11, 2015, which is incorporated herein in its entirety.

BACKGROUND

Transport of radio wave systems that use some form of electromagnetic reflecting antenna, i.e., radar or communications, is cumbersome, partially because of the antenna. Such antennas require an electromagnetically reflective substance, a metal, to operate, which has meant that the antenna is heavy and not easily stowed for transport. Collapsible metal antennas have often been used. Of course, these antennas are weighty and require complex actuator systems to be deployed.

Recently, antennas have been formed from lightweight materials such as composites, and polymers. These render the antenna light in weight compared to metal versions, but such antennas need other structures to maintain the shape of the reflector in a parabolic dish when the antenna is deployed in order not to degrade or inhibit the electromagnetic signal.

Often such antennas include rigid members to maintain the shape of the reflector, for example, a plurality of rigid ribs, as described in U.S. Pat. No. 3,978,490 to Talley, et al.; U.S. Pat. No. 7,710,348 to Taylor, et al.; and U.S. Pat. No. 8,259,033 to Taylor, et al. Other antennas employ other "rigidizing" means, such a rigid toroidal member incorporated in the periphery of the reflector dish shown in U.S. Pat. No. 4,755,819 to Bernasconi, et al. in which the antenna reflector comprises an uncured resin in the undeployed state and a toroidal member, both of which are that configured to be inflated to deploy the reflector. When the resin encounters heat from the sun, the reflector hardens and maintains its shape. U.S. Pat. No. 6,272,449 to Bokulic, et al., also discloses a flexible antenna incorporating an inflating toroid. Still other antennas incorporate some other rigid structures to maintain the reflector's shape. For example, U.S. Pat. No. 6,642,796 to Talley, et al. discloses an antenna that includes a rigid center with bendable sections extending from the edge of the rigid center.

These rigidizing members and these latter "light-weight" antennas still add weight to the antenna system and require accommodations for space of any non-flexible, or non-folding structures. Even the inflatable versions require systems and plumbing to inflate the structures, adding more weight and complexity to the system.

Accordingly, a foldable antenna that does not require such rigid components is needed.

BRIEF DESCRIPTION OF THE DRAWINGS

The apparatus is described with reference to the accompanying drawings. In the drawings, like reference numbers indicate identical or functionally similar elements.

FIG. 11A is a detailed view showing how the reflector supports attach to the reflector;

FIG. 11B is a detailed view showing how the ground support legs attach to the azimuth and elevation positioning assembly;

FIG. 11C is an exemplary ground support leg with a cable port of the assembly depicted in FIG. 11.

FIG. 11D is an exemplary connector coupling to an adapter in accordance with an embodiment of the present disclosure FIG. 11E is an exemplary adapter shown in relation to the connector as depicted in FIG. 11C.

FIG. 11F is an exemplary adapter coupled to a connector as depicted in FIG. 11C.

FIG. 11G is a cross-sectional view of the adapter depicted in FIG. 11F.

DETAILED DESCRIPTION

Figure 1:
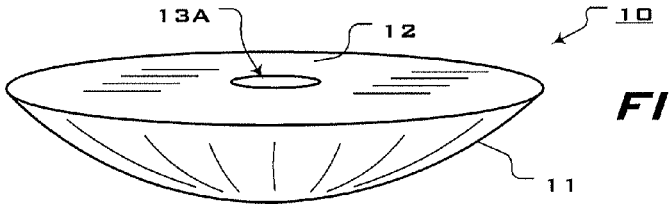
FIG. 1 illustrates an exemplary embodiment of a foldable radio wave antenna.
Figure 2:
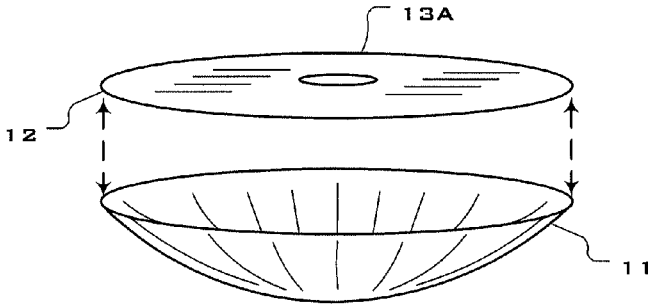
FIG. 2 is an exploded view of the components of the foldable antenna of FIG. 1.
Figure 3:
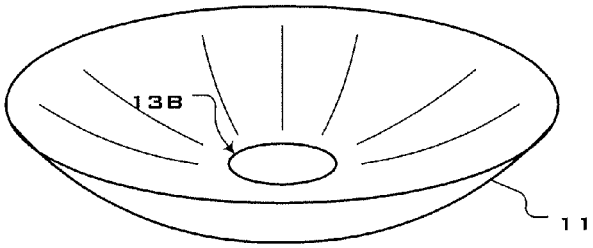
FIG. 3 shows the concave side of an exemplary foldable reflector.

The various embodiments of the foldable antenna and their advantages are best understood by referring to FIGS. 1 through 15B of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

A foldable antenna 10 comprises a flexible reflector member 11 and a flexible tension member 12. In its unfolded state, reflector member 11 is a generally parabolic dish having an opening 13*b* defined through its wall and centered at the vertex of the parabola. In its unfolded state, tension member 12 comprises a planar, circular member and also includes an opening 13 defined through it at its center.

A suitable antenna 10 is flexible enough to be folded with a low bending radius but with the tendency to stay folded without assistance. The reflector member 11 must exhibit a low flexural modulus, and a high tensile modulus in plane, possessing "shape memory", i.e., a tendency of the reflector member 11 to return to its parabolic shape, but with a very low tendency to set when elastically deformed, i.e., creasing along the fold. Thus, the reflector member 11 may be folded and unfolded repeatedly without deterioration of signal quality. The material comprising the reflector member 11 is a composite having a high-elastic-modulus formed of woven fibers, e.g., fiberglass, carbon fiber or aramid, combined with a flexible, but resilient, elastomer binder matrix, for example, silicone resin, polyurethane, or synthetic rubber. The fiber composite layer could also be a composite of cloth or paper with a phenolic resin as would be appreciated by those skilled in the relevant arts.

The parabolic shape preferably has a relatively high depth-to-diameter ratio, i.e., focal length/diameter (f/d), of between about 0.25 to about 0.30, and confers an automatic increase in short-range and long-range moment of inertia as it unfolds.

Of course, since it is intended to function as an electromagnetic reflector, the reflector member 11 also comprises an electromagnetically reflective fabric, for example, metal-nylon mesh. In one embodiment, reflector member 11 comprises a laminate of an electromagnetically reflective fabric encased in multiple layers of a fiber composite, involving elastomer and aramid. In order to ensure a uniform flexion in all directions, the fibers of each fiber composite layer may be oriented at an offset with respect to adjacent or nearby fiber composite layers. For example, the fibers of a first fiber composite layer may be oriented in a first orientation. The next fiber composite layer may be oriented such that its fibers are angularly offset by about 45° relative the orientation of the fibers of the first layer. The succeeding fiber composite layer may be oriented such that its fibers are angularly offset by about 45° relative the fibers of the preceding layer, and so on.

Thickness of the resulting laminate should be sufficient to be resilient and retain shape memory of the parabolic considering the diameter of the reflector, but thin enough to be folded to a low bend radius. For example, if the laminate is not thick enough, it will not hold its shape when it is deployed. If it is too thick, the reflector will not be pliant enough to fold. For a reflector diameter of 0.9 m, a suitable thickness is about 50 mils.

Figure 8:
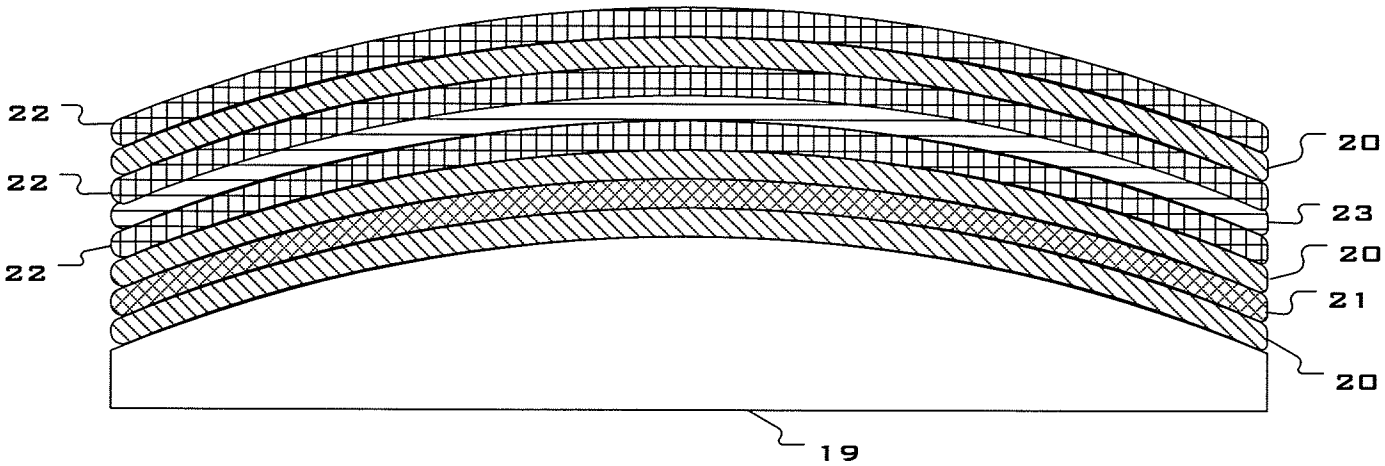
FIG. 8 illustrates an exemplary laminate comprising the reflector member.

With reference to FIG. 8, the reflector member 11 may be formed by laying the multiple layers of material over a mandrel 19 of the desired f/d ratio. The first layer in this example is a fiber elastomer composite layer 20 and is overlaid with a metal nylon mesh layer 21. Another fiber composite layer 20 overlays the mesh layer 21. An aramid layer 23 is then placed over which is laid other fiber composite layers 20. More layers of fiber composite 20 may be added. As will be appreciated by those skilled in the art, the layers, in some embodiments, may be bonded together using heat, a vacuum or combinations of both.

Figure 5:
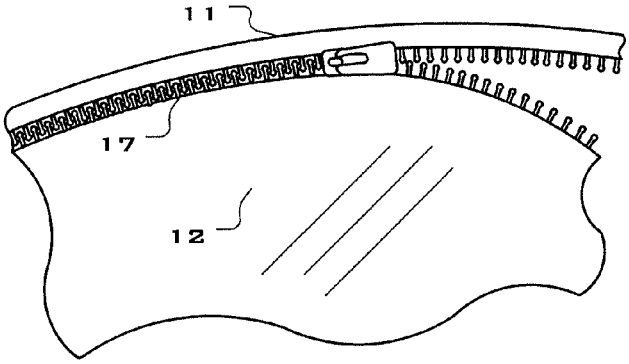
FIG. 5 depicts one means of attaching the tension member to the foldable reflector member.
Figure 6:
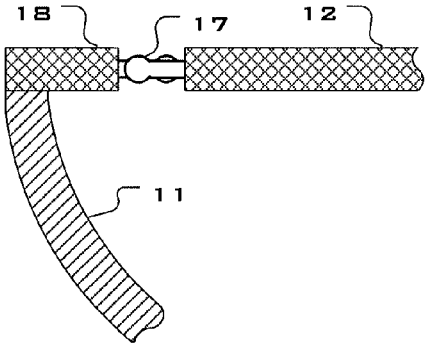
FIG. 6 is a section view of the zipper depicted in FIG. 5.

Tension member 12 is also foldable and may also comprise a laminate of layers of fiber composite and an elastomer binder and may be between about 6 to about 8 mils in thickness having a diameter roughly equal to that of the reflector member 11. In one embodiment, tension member 12 is permanently bonded by its circumferential edge to the peripheral rim of the reflector member 11. In another embodiment, shown in FIG. 2, the tension member 12 may be detachable from the reflector member 11. With reference to FIGS. 5 and 6, a circumferential zipper 17 may be used to attach tension member 12 to the reflector member 11. Once attached, the tension member 12 draws the peripheral rim of the reflector member 11 centrally ensuring the edges maintain a circular shape. This reduces warping in the reflector member's 11 dish shape which would otherwise degrade antenna performance.

Zipper 17 may be installed by attaching a rim 18 that may comprise the same laminate as that of the tension member 12 to the peripheral rim of the reflector member 11 and attaching one side of the zipper to the radially inward edge of the rim 18. It will be appreciated that preferably zipper 17 comprises an electromagnetically transparent material to avoid interference with the radio wave signals. In addition, other means of attaching the tension member 12 to the reflector member 11 may be employed as will be appreciated by those skilled in the art.

Figure 4:
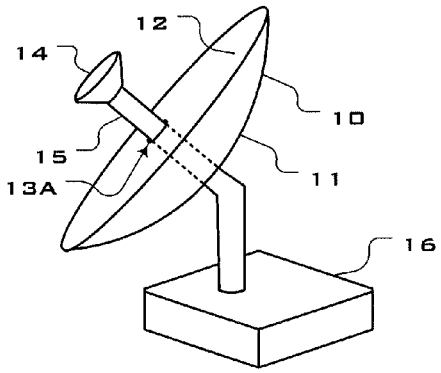
FIG. 4 illustrates an exemplary foldable antenna installed on an exemplary antenna positioning apparatus.

FIG. 4 illustrates the antenna 10 deployed with an exemplary antenna control system 16. A mast 15 extends from the control system 16. The antenna 10 is mounted to the mast 15 by inserted the mast 15 through the openings 13*a, b* in the reflector member 11 and the tension member 12. A feed horn 14 is located on the end of the mast 15.

Figure 7:
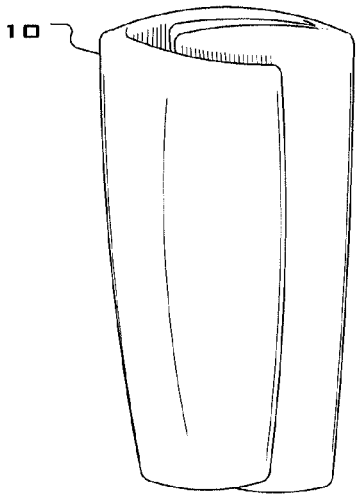
FIG. 7 shows an antenna folded.

When the antenna 10 is to be stowed, it is removed from the mast 15 and the tension member 12 is detached from the reflector member 11. Both the tension member 12 and the reflector member 11 may then be refolded, as illustrated in FIG. 7.

Figure 9:
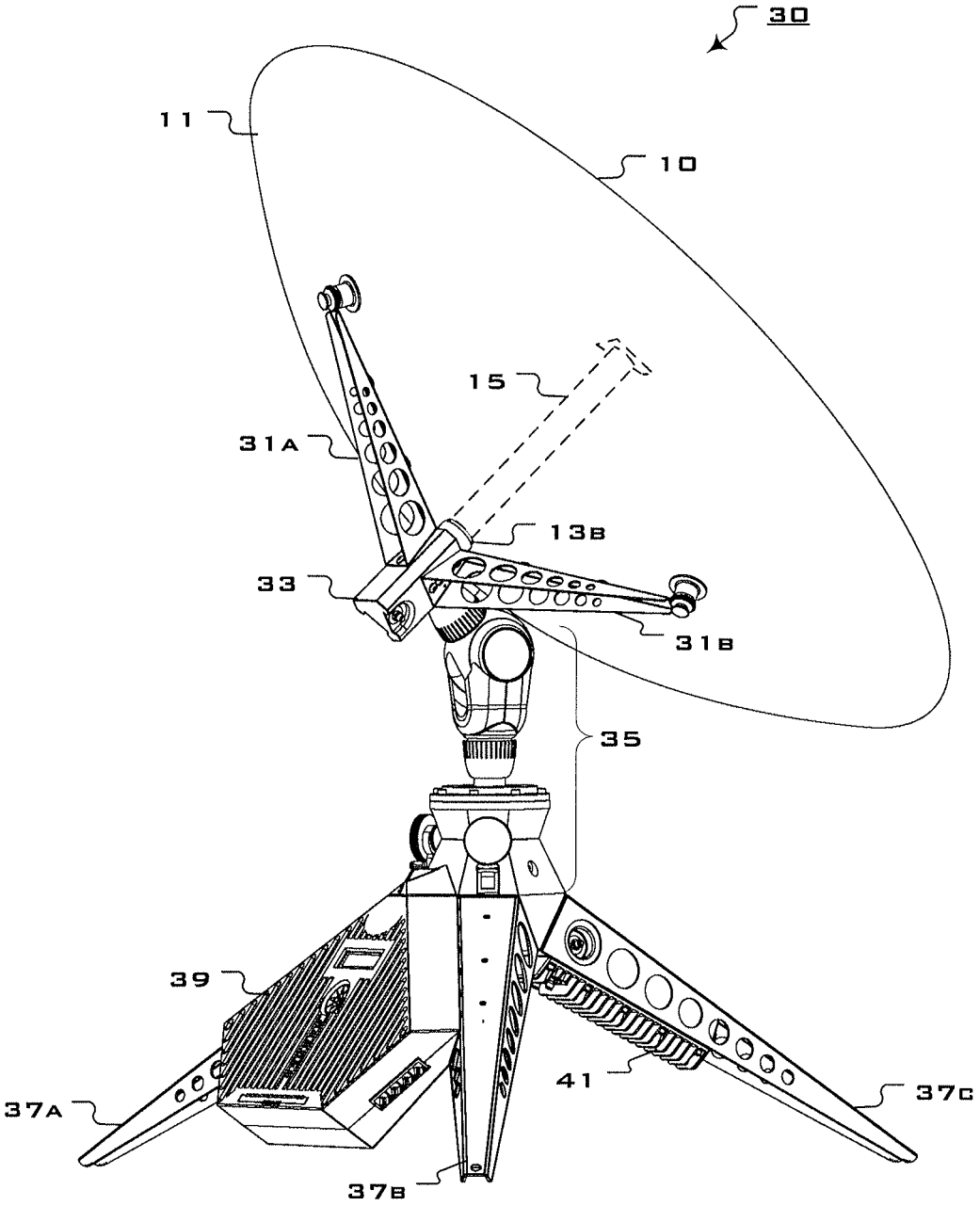
FIG. 9 is an isometric view of an exemplary ground-based satellite communication system on which a foldable antenna is mounted.
Figures 10A, 10B, 10C:
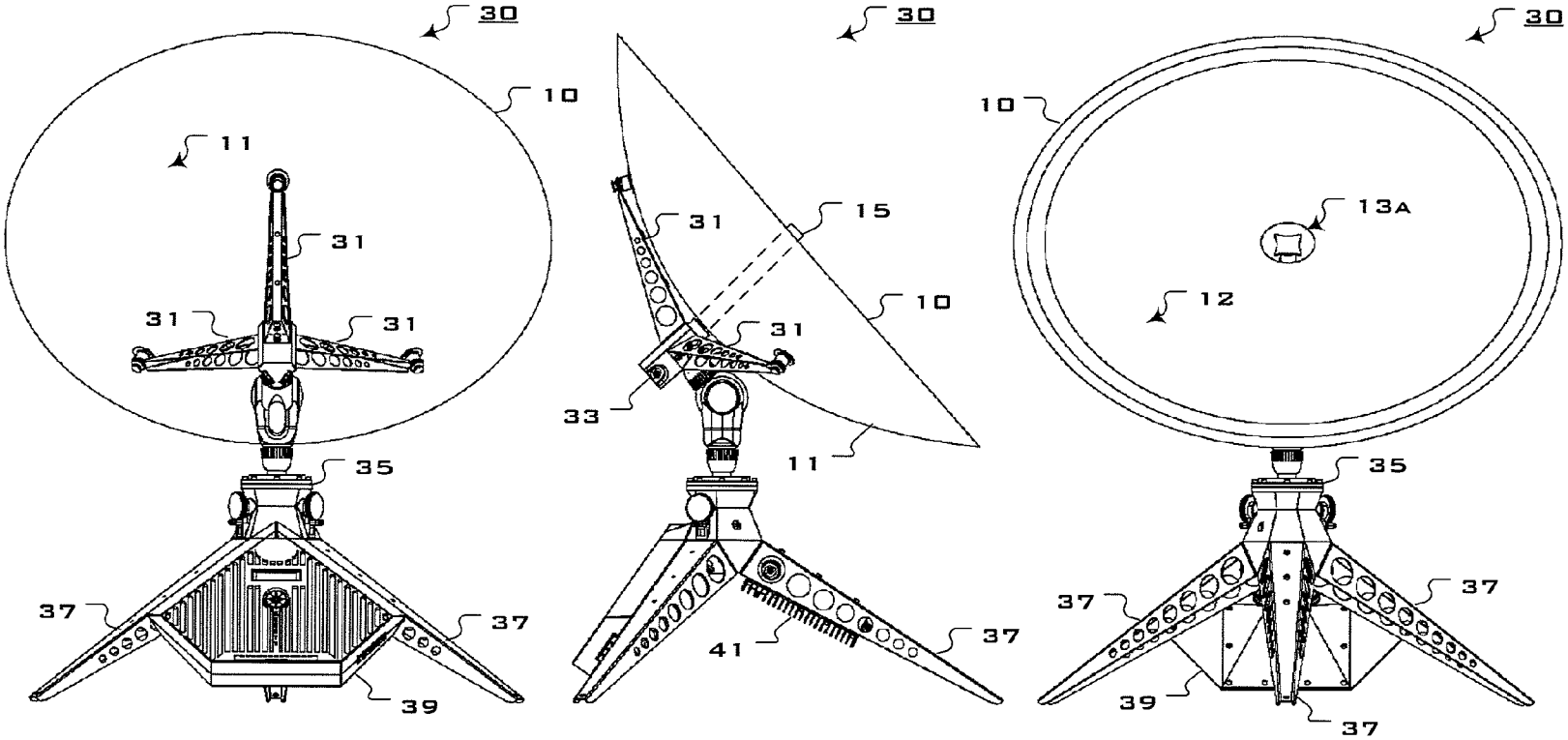
FIGS. 10A through 10C are rear, side and front views of the assembly of FIG. 9.
Figure 11:
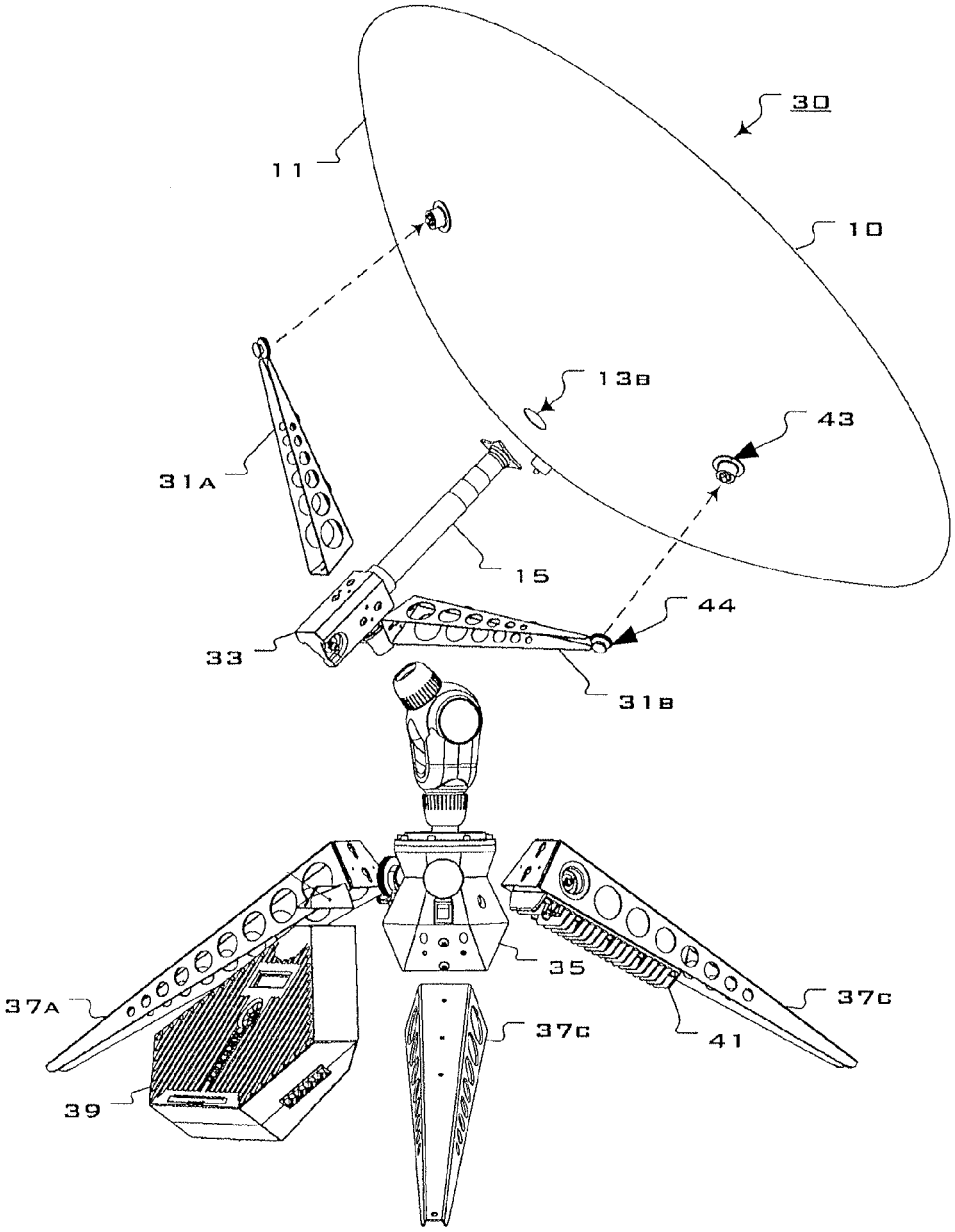
FIG. 11 is an exploded view of the assembly of FIG. 9.

FIGS. 9-10 show an exemplary ground-based satellite communication system 30 that employs the foldable antenna 10 described above with reference to FIG. 1. A feed assembly 33 provides a centrally disposed housing on which to mount a plurality of reflector supports 31*a, b* that extend radially from the feed assembly 33. The radially outward ends of the supports are attached by fasteners to the back surface of the reflector 11 of the antenna 10. A feed mast 15 extends from the feed assembly 33 through openings 13*b*, 13*a*, in the reflector member 11 (FIG. 11), and the tension member 12 (FIG. 10C), respectively.

The feed assembly 33 is mounted to the top of an azimuth and elevation positioning assembly 35, the lower portion of which comprises a generally vertical housing defining a hub to which a plurality of ground support legs 37*a-c* are mounted by respective radially inner ends thereof. A transceiver assembly 41 is attached to one leg 37*c* while a modem/router assembly 39 is mounted to the remaining two ground support legs 37*a, b*.

Turning now to FIGS. 11A & B an exemplary means for attaching the reflector support 31 to the back surface of the reflector 11. In this example, the radially outward end of the reflector supports 31 comprises a socket assembly 44 configured with a button that is spring-biased in a down position with respect to the socket assembly. A plurality of jaws inside the socket is biased to narrow the opening defined in the socket and configured to open when the button is pulled up away from the assembly. The socket assembly 44 mates with a corresponding stud 43 attached to the back surface of the reflector 11 and comprising a generally bulbous head. The socket is pressed onto the stud allowing the plurality of jaws to self-engage and grip the bulbous head thereof, biased to the closed position. To remove the socket assembly 44, the button is pulled away opening the plurality of jaws releasing the bulbous head. An example of this type of fastener is known as a "pull-it-up fastener".

FIG. 11B depicts attachment of the ground support legs 37 to the azimuth and elevation positioning assembly 35 housing. Posts 45 extend from the walls of the housing that correspond to generally keyhole-shaped slots 46 defined in a wall of the radially inner end of the support leg 37. It will be appreciated that the radially inner ends of the reflector supports 31 may be mounted to the feed assembly in the same or similar manner.

FIG. 11C depicts an exemplary support leg 37A in accordance with an embodiment of the present disclosure. In this regard, the ground support leg 37A comprises an opening 110 therein through which a cable, e.g., a SubMiniature version A (SMA), may be inserted to couple a communication cable with electronics of the satellite communications assembly 30.

Inserted within the opening is a threaded connector 111. In one embodiment, the connector 111 comprises an opening not shown. The opening is adapted for receiving a pin of a cable being coupled to the satellite communications assembly 30.

Within the housing is a bushing 112 that extends circumferentially around the connector 11. The busing 110 comprises a radial wall 131 that extends from a face 132 of the ground support leg 37A. In one embodiment, the busing comprises an elastomeric material such that the inner portion of the wall 131 exhibits little friction when an adapter (shown in FIG. 11D) is inserted within the bushing and coupled to the connector 111.

FIG. 11D is an exemplary adapter 113 for coupling a cable 150, e.g., a SMA cable, to the connector 111 (FIG. 11C). The adapter 113 comprises a cylindrical housing 133 for inserting within the bushing 112 (FIG. 11C) and coupling to the connector 111. Additionally, the adapter 113 comprises a flange 135 at the base of the cylindrical housing 133 and integral therewith.

Note that in one embodiment, the housing 133 and the flange 135 are integral pieces forming a single housing. However, other configurations are possible in other embodiments.

The cylindrical housing 133 comprises an opening 114 that exposes a connector 151. In this regard, the cable 150 comprises a terminator 140 that houses the connector 151. The terminator 140 comprises a rotatable bolt 142 that is fixedly coupled to the terminator 140. Further, an inside wall of the terminator is threaded. The adapter 113 is coupled to the rotatable bolt 142 via lock pins 155, which fixedly coupled the adapter 113 to the terminator 140 and the bolt 142. When installed, the when the adapter 113 is rotated, the terminator 140 rotates with the adapter 113.

FIG. 11E depicts the adapter 113 housing the terminator 142 (FIG. 11D) and coupled to the cable 150. FIG. 11E shows the adapter 113 as it is being aligned by a user (not shown) with an opening 153 in the bushing 112.

Note that the busing 112 forms a radial wall 154 and corresponding opening 153 for receiving the adapter 113. As the adapter 113 is being inserted within the opening 153, the radial wall 154 guides the connector contained in the adapter to the connector 151 (FIG. 11D.

FIG. 11F depicts the end of the adapter 113 inserted in the bushing 112. In this regard, the cylindrical housing 133 of the adapter 113 is inserted within the bushing 112. The wall 131 of the busing 112 guides the connector 151 of the terminator 140 to the connector 111 (FIG. 11C). As noted hereinabove, the inner wall 153 of the busing may comprise an elastomeric material that makes the housing 133 more easily insertable into the bushing 112. The housing 133 and the bushing 112 makes the coupling of the corresponding connectors easier. Once the housing 133 is inserted within the bushing, the installer (not shown) then rotates the adapter 113, which in turn rotates the bolt 142 thereby coupling the connector 142 to the connector 111.

FIG. 11G is a cross sectional view of the adapter 113 inserted in the bushing 112. In this regard, the cable 150 is coupled to the terminator 140 by fixedly coupling the adapter 113 to the bolt 142. The connector 151 is inserted within the connector 111 establishing electrical connection between the cable 150 and the electronics of the satellite communications assembly. As described hereinabove, when the adapter 113 is inserted within the bushing 112, the installer rotates the adapter 113, which rotates the bolt 142 and couples the connector 151 to the connector 111.

Figure 12:
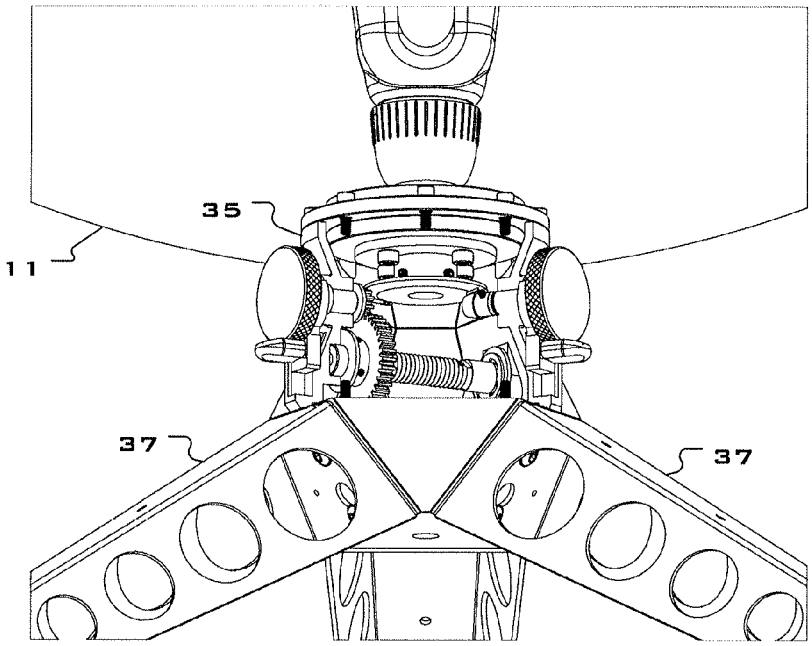
FIG. 12 depicts an exemplary azimuth and elevation position mechanism.
Figure 13:
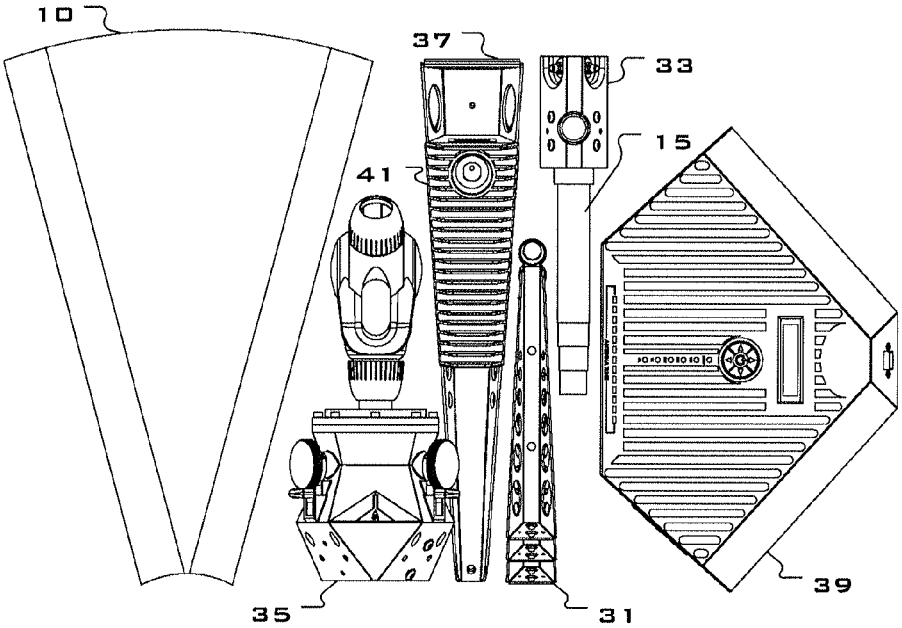
FIG. 13 illustrates a disassembled exemplary satellite communication system arranged to be stowed and transported.

FIG. 12 presents a detailed view of the interior of the azimuth and elevation positioning assembly 35. FIG. 13 presents the various components of the entire satellite communications assembly 30, disassembled and arranged for compact stowage. It will be appreciated that the antenna 10 is folded as described above. As shown in detail in FIGS. 15A & B, ground support legs 37 and reflector supports 31 may be configured to define an elongated cavity 48, 49, respectively, shaped and dimensioned to receive other support legs or reflector supports, as the case may be. Thus, allowing the support legs 27 and the reflector supports 31 to be arranged in a nested configuration. Further, in an embodiment, the feed mast 15 may comprise a telescoping feed mast 15, permitting the mast 15 to be retracted for stowage and transport, and extended for assembly and deployment.

Figure 14A:
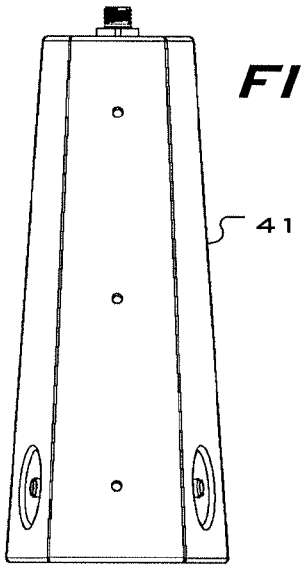
FIG. 14A-E present various views of an exemplary transceiver assembly.
Figure 14B:
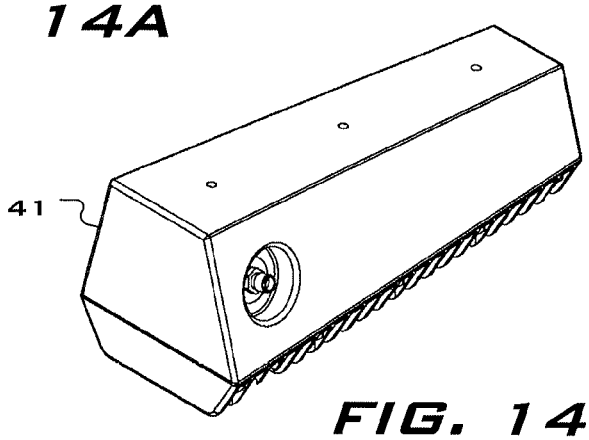
Figure 14C:
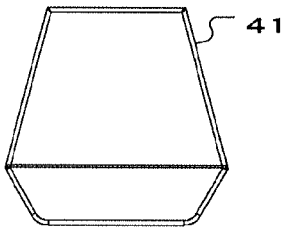
Figure 14D:
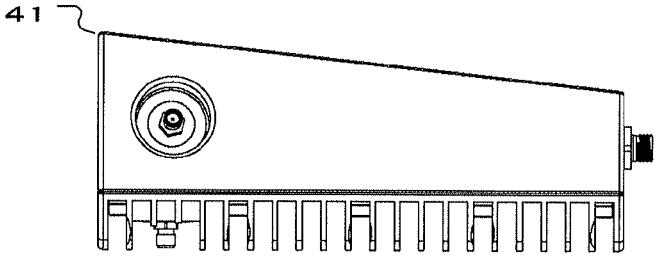
Figure 14E:
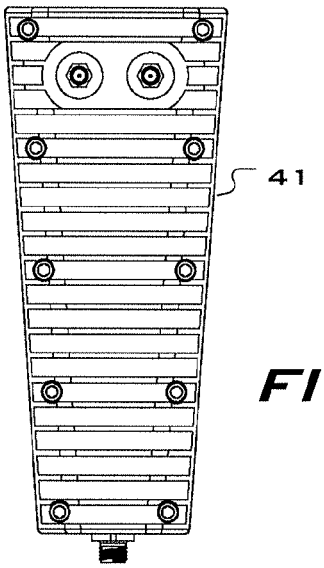
Figure 14F:
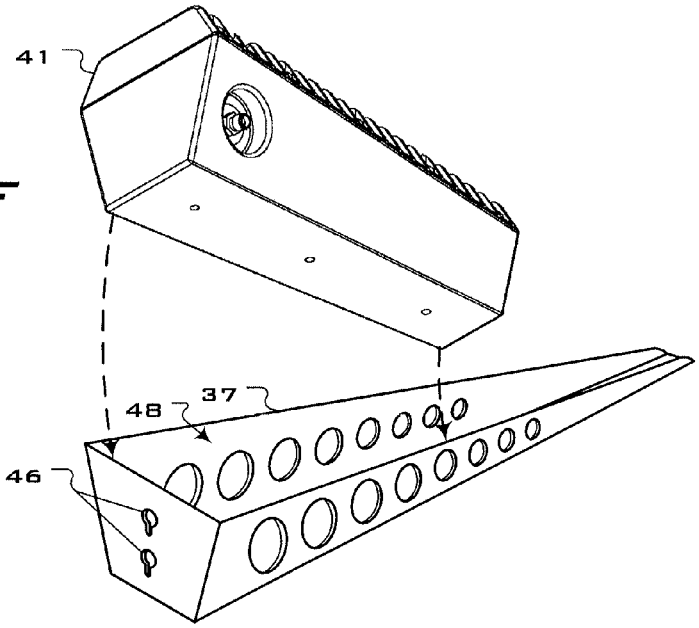
FIG. 14F depicts the fitting of the transceiver assembly of FIGS. 14A-E with a ground support leg.
Figure 15A:
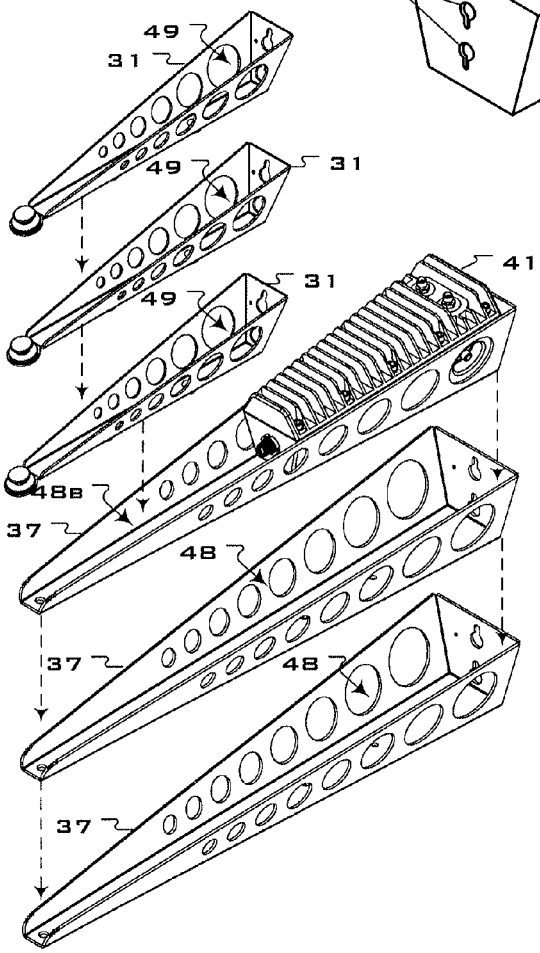
FIG. 15A is an exploded view of the ground support legs and the reflector supports arranged for stowage.
Figure 15B:
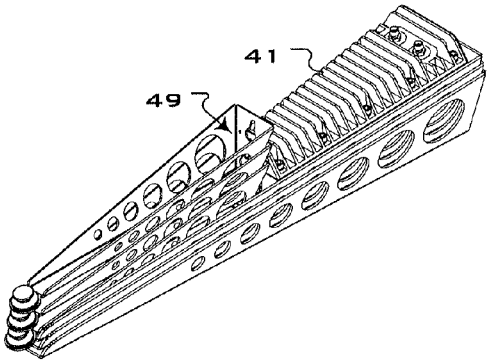
FIG. 15B shows the ground support legs and the reflector supports in a nested arrangement for stowage.

Turning now to FIGS. 14A through E, various perspectives of an exemplary transceiver assembly 41 are shown. It can be seen a transceiver assembly 41 may comprise a housing shaped and dimensioned to conform with the elongated cavity 48 defined in the ground support legs 37. Accordingly, the transceiver assembly 41 may be fitted within the cavity 48 and attached to the support leg 37, as depicted in FIG. 14F. It will be appreciated that in an embodiment in which the transceiver is thus attached to a ground support leg 37, the transceiver assembly 41 housing may comprise a length such that when it is seated within the cavity 48 of the ground support leg 37, a portion of the cavity 48*b* remains open. Further, each of the reflector supports 31 may be dimensioned with a length, and shape, to fit within the open portion of the cavity 48 such that the plurality of the reflector supports 31 may not only be nested within themselves, but the nested group may be nested with the ground support legs 37 (FIG. 15B).

As described above and shown in the associated drawings, the present invention comprises a ground-based satellite communication system for a foldable radio wave antenna. While particular embodiments have been described, it will be understood, however, that any invention appertaining to the system described is not limited thereto, since modifications may be made by those skilled in the art, particularly in light of the foregoing teachings. It is, therefore, contemplated by the appended claims to cover any such modifications that incorporate those features or those improvements that embody the spirit and scope of such invention.

What is claimed is:

1. A satellite communications assembly, comprising:

a foldable antenna comprising a flexible concave reflector member and a flexible flat tension member attached to the rim of the reflector member by a zipper;

a feed assembly centrally disposed with respect to the foldable antenna;

a plurality of reflector supports that extend radially from the feed assembly and coupled to the reflector member, wherein each reflector support comprises a socket assembly on a reflector attaching end;

a hub coupled to the feed assembly, the hub coupled to ends of a plurality of ground support legs.

2. The satellite communications assembly of claim 1, wherein each socket assembly comprises a socket and within each socket is a plurality of jaws that are actuated by depression of a button.

3. The satellite communications assembly of claim 2, where when the buttons are actuated, the jaws open, and the jaws grasp respective studs coupled to the reflector.

4. The satellite communications assembly of claim 3, wherein the studs have bulbous heads.

5. The satellite communications assembly of claim 1, wherein a transceiver assembly is attached to one of the plurality of ground support legs.

6. The satellite communications assembly of claim 1, wherein a modem/router assembly is mounted to two of the plurality of ground support legs.

7. The satellite communications assembly of claim 1, wherein one of the ground support legs comprises an opening that houses a connector.

8. The satellite communications assembly of claim 7, wherein the opening comprises a bushing that extends outward from a face of the ground support leg.

9. The satellite communications assembly of claim 8, further comprising an adaptor, wherein the adaptor comprises a first generally cylindrical housing having an opening therein for receiving a terminator of a cable.

10. The satellite communications assembly of claim 9, wherein the generally cylindrical housing is fixedly coupled to a rotating bolt on the terminator, such that when the adaptor is rotated, the terminator rotates with the rotation of the adapter.

11. The satellite communications assembly of claim 10, wherein the adapter further comprises a second generally cylindrical housing comprising a connector for receiving a cable.

12. The satellite communications assembly of claim 11, wherein the adapter further comprises a flange disposed between the first cylindrical housing and the second cylindrical housing.

13. The satellite communications assembly of claim 12, wherein the first cylindrical housing, the second cylindrical housing, and the flange are a unitary component.

14. A satellite communications assembly, comprising:

a foldable antenna comprising a flexible concave reflector member and a flexible flat tension member attached to the rim of the reflector member;

a feed assembly centrally disposed with respect to the foldable antenna;

a plurality of reflector supports that extend radially from the feed assembly and coupled to the reflector member, wherein each reflector support comprises a socket assembly on a reflector attaching end;

a hub coupled to the feed assembly, the hub coupled to ends of a plurality of ground support legs.

* * * * *